United States Patent [19]

Ishii

[11] Patent Number: 5,009,204

[45] Date of Patent: Apr. 23, 1991

[54] SPARK PLUG ARRANGEMENT IN AN OVERHEAD CAMSHAFT ENGINE

[75] Inventor: Norio Ishii, Mitaka, Japan

[73] Assignee: Fuji Jukogyo Kabushiki Kaisha, Tokyo, Japan

[21] Appl. No.: 441,077

[22] Filed: Nov. 24, 1989

[30] Foreign Application Priority Data

Nov. 30, 1988 [JP] Japan ..... 63-303381

[51] Int. Cl.[5] ..... F02F 1/32

[52] U.S. Cl. ..... 123/193 H; 123/432

[58] Field of Search ..... 123/308, 432, 315, 193 H

[56] References Cited

U.S. PATENT DOCUMENTS 4,553,515 11/1985 King et al. ..... 123/315
4,714,059 12/1987 Masuda et al. ..... 123/315
4,741,302 5/1988 Oda et al. ..... 123/315

FOREIGN PATENT DOCUMENTS 60-187706 9/1985 Japan .
61-138862 6/1986 Japan .

*Primary Examiner*—E. Rollins Cross
*Attorney, Agent, or Firm*—Martin A. Farber

[57] ABSTRACT

An overhead camshaft engine has a cylinder head, two intake valves and two exhaust valves at each cylinder. A plug hole is formed in a space of a cylinder head between the intake valves and between the intake valves and a camshaft. An end of the plug hole is opened to a combustion chamber at a center position thereof. A spark plug is mounted in the plug hole, so that a center electrode of the spark plug is positioned at the center position.

1 Claim, 2 Drawing Sheets

SPARK PLUG ARRANGEMENT IN AN OVERHEAD CAMSHAFT ENGINE

BACKGROUND OF THE INVENTION

The present invention relates to an arrangement of a spark plug in a cylinder head of a single overhead camshaft engine having two intake valves and two exhaust valves at each cylinder.

In such a four-valve type engine, it is preferable to dispose a spark plug at a center of a square formed by quadrangularly positioned valves for the sake of improvement of the ignition of an air-fuel mixture and flame propagation. However, in the single overhead camshaft engine, a camshaft is disposed in a vertical plane including the center of the square so that it is difficult to position the spark plug at the center.

Japanese Patent Application Laid-Open 60-187706 discloses a single overhead camshaft engine having four valves at each cylinder wherein a spark plug is obliquely disposed between intake-valve rocker arms so that a center electrode of the spark plug is placed in the center of the combustion chamber. However, a large space is necessary between the intake valves to dispose the spark plug. As a result, the inclination angle of the valves inevitably increase, so that the engine cannot be made compact. On the other hand, in the case of a horizontal opposed type engine, since the axis of an elongated hole in which disposing the spark plug is disposed is parallel to the intake valves, it is difficult to change the spark plug for a new one.

In another arrangement disclosed in Japanese Patent Application Laid-Open 61-138862, a spark plug is obliquely disposed between two exhaust ports. In such an arrangement, the spark plug is subjected to heat the exhaust ports. In order to protect the spark plugs from the exhaust heat, coolant passages are provided between the spark plug and the exhaust ports. Since the coolant passages occupy a space, the engine becomes large in size. On the other hand, in case of the horizontal opposed type engine, since a hole in which the spark plug is disposed opens at a lower side of the engine, it is impossible to change the spark plug for a new one.

SUMMARY OF THE INVENTION

The object of the present invention is to provide an arrangement of a spark plug in a four-valve type engine wherein the spark plug is disposed at a center portion of a combustion chamber of the engine without increasing the valve angle and hence without increasing the size of the engine.

The other objects and features of this invention will become understood from the following description with reference to the accompanying drawings.

DETAILED DESCRIPTION OF THE PREFERRED EMBODIMENT

Figure 1:
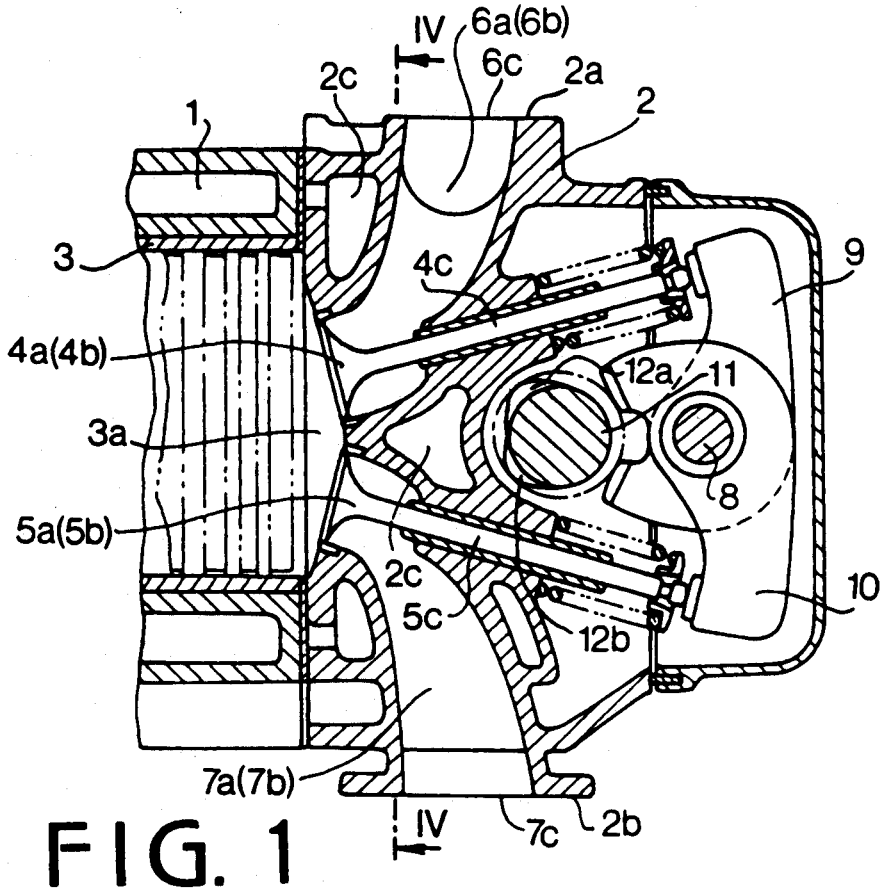
FIG. 1 is a sectional view of a part of a single overhead camshaft engine.
Figure 2:
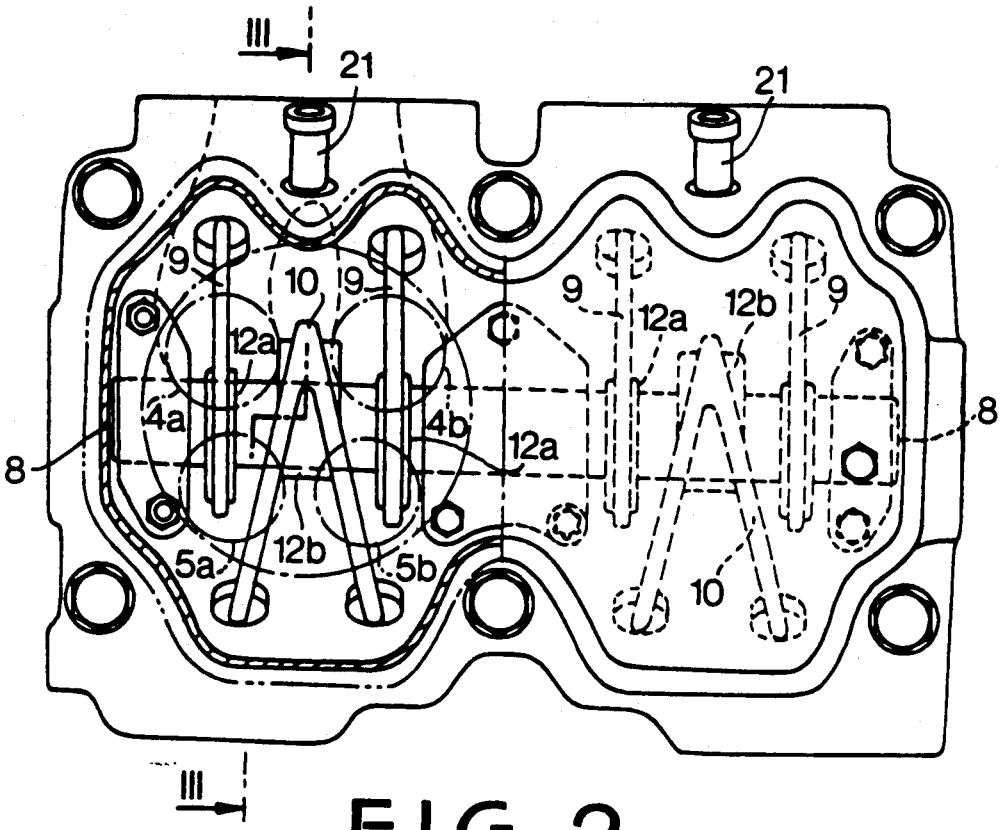
FIG. 2 is a partially cutaway elevational view of the engine.

Referring to FIG. 1, the single overhead camshaft engine to which the present invention is applied comprises a cylinder block 1 housing cylinders 3 therein, and a cylinder head 2. A pair of intake valves 4*a*, 4*b* and a pair of exhaust valves 5*a*, 5*b* are provided for each cylinder. The intake valves 4*a*, 4*b* and the exhaust valves 5*a*, 5*b* are quadrangularly disposed about the axis of each of the cylinders 3, as shown in FIG. 2. A combustion chamber 3*a* of each cylinder 3 communicates with intake ports 6*a*, 6*b* and with exhaust ports 7*a*, 7*b*. An end 6*c* of each intake port 6*a* (6*b*) is opened at a side 2*a* of the cylinder head 2, and an end 7*c* of each exhaust port 7*a* (7*b*) is opened at the other side 2*b* of the cylinder head 2. Water jackets 2*c* are formed in the cylinder head 2 adjacent the valve 4*a*, 4*b*, 5*a*, 5*b* and the ports 6*a*, 6*b*, 7*a*, 7*b*.

As shown in FIGS. 1 and 2, a valve mechanism has a camshaft 11 rotatably mounted in the cylinder head 2 in a space between the intake valves 4*a*, 4*b* and the exhaust valves 5*a*, 5*b*, in parallel to a crankshaft (not shown) of the engine. For each cylinder 3, a pair of intake valve cams 12*a* and an exhaust valve cam 12*b* between the intake valve cams 12*a* are formed on the camshaft 11. A rocker arm shaft 8 is disposed above the camshaft 11 in the cylinder head 2 in parallel thereto. Pivotally mounted on the rocker arm shaft 8 are a pair of rocker arms 9 for the intake valves 4*a*, 4*b* and a bifurcated rocker arm 10 for the exhaust valves 5*a*, 5*b*. One end of each rocker arm 9 is pressed against the cam 12*a* and the other end engages with an upper end of a stem 4*c* of the intake valve 4*a* (4*b*). Similarly, a base end of the rocker arm 10 is pressed against the cam 12*b* and each bifurcated end abuts on an upper end of a stem 5*c* of the exhaust valve 5*a* (5*b*). Thus, when the camshaft 11 is rotated in synchronism with the crankshaft of the engine, the intake and exhaust valves 4*a*, 4*b*, 5*a*, 5*b* are operated at predetermined timings.

Figure 3:
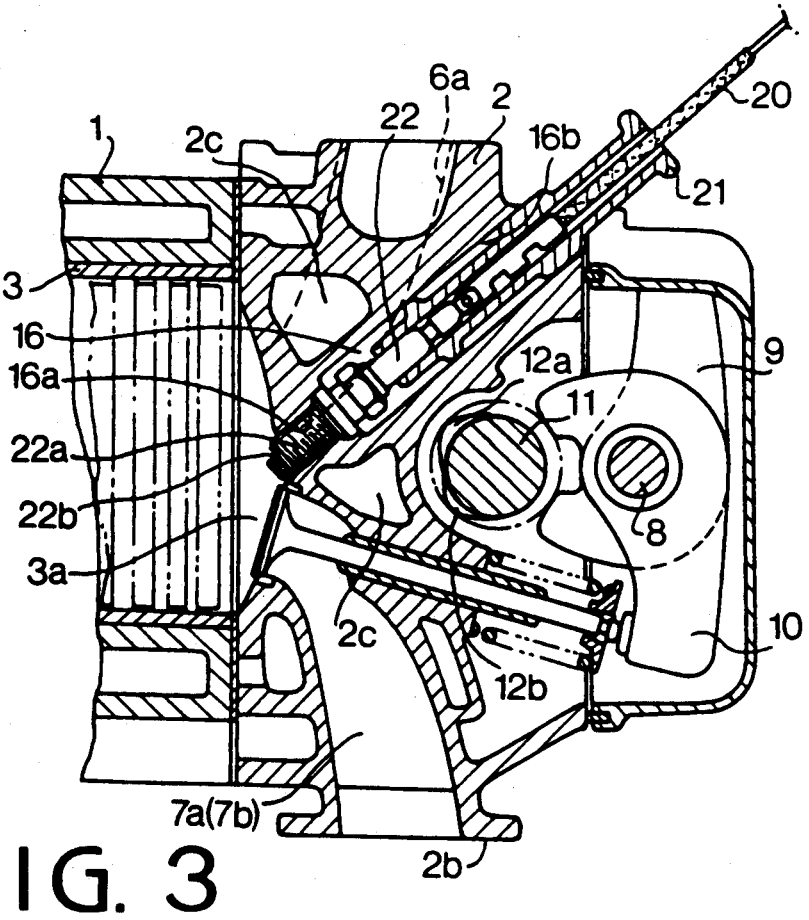
FIG. 3 is a sectional view of the engine taken along a line III—III of FIG. 2.
Figure 4:
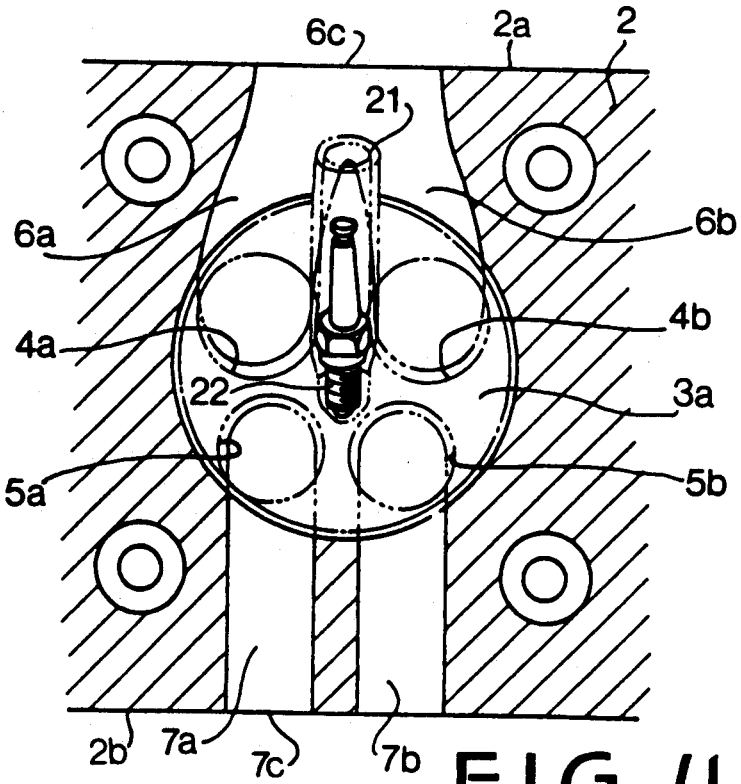
FIG. 4 is a sectional view of the engine taken along a line IV—IV of FIG. 1.

As shown in FIGS. 3 and 4, a plug hole 16 is formed in the cylinder head 2 between the intake ports 6*a* and 6*b* and between the intake ports and the camshaft 11. The plug hole 16 is inclined with respect to the axis of the cylinder 3. A tapped lower end 16*a* of the hole 16 opens into the combustion chamber 3*a* at a central portion of the top wall of the chamber, and an upper end 16*b* is opened at the side 2*a* of the cylinder head 2 between the intake ports 6*a* and 6*b*. A spark plug 22 connected to a high tension cord 20 and carried in a holder 21 is inserted in the hole 16. A threaded end 22*a* of the spark plug 22 is screwed in the tapped lower end 16*a* so that a center electrode 22*b* projects into the central portion of the combustion chamber 3*a*. Thus, the spark plug 22 is disposed adjacent the intake ports 6*a*, 6*b* and the water jackets 2*c*.

In accordance with the present invention, since a spark plug is disposed between the intake valves, it is possible to position a center electrode thereof at the center of a combustion chamber without increasing an inclination angle between the valves. Consequently, inclinations of the valves can be decreased, thereby decreasing the size of the engine. Moreover, since the center electrode is placed at the center of the combustion chamber, air-fuel mixture can be properly ignited and the flames effectively propagated. Consequently, fuel consumption and emission control as well as engine efficiency are improved.

In addition, the spark plug can be easily removed from the side of the cylinder head without interference by the rocker arms or camshaft. Especially in the case of a horizontal opposed type engine, it is possible to easily change the spark plug for a new one. Thus, the maintenance of the engine and the adjustment of a valve mechanism is simplified. Furthermore, even though the temperature of the engine is high, the spark plug is cooled by the air-fuel mixture passing in the intake ports and the coolant in the water jackets so that deterioration caused by heat is prevented.

While the presently preferred embodiment of the present invention has been shown and described, it is to be understood that various changes and modifications may be made without departing from the scope of the invention as set forth in the appended claims.

What is claimed is:

1. In a spark plug arrangement in a single overhead camshaft engine having a cylinder head, two intake valves partially in two intake ports and two exhaust valves at each cylinder provided in the cylinder head and only one overhead camshaft rotatably mounted in the cylinder head intersecting an extension of a center axis of said cylinder and disposed in a space between the intake valves and the exhaust valves for actuating said intake and exhaust valves by rocker arms, the improvement in the arrangement comprising:

a spark plug mounted in a plug hole in said cylinder head provided between said two intake valves and along and between said intake ports said spark plug defining an angle between said exhaust valves with said intake valves located in said angle between said spark plug and said exhaust valves, said intake valves defining substantial acute angles with said exhaust valves and with said spark plug, respectively, with the acute angle between said exhaust valves and said intake valves being larger than the acute angle between said spark plug and said intake valves, the spark plug and the plug hole being arranged so that a center electrode of the spark plug is positioned at said center axis with minimum inclination angle between said valves.

* * * * *